US009538839B2

(12) United States Patent
Favaro

(10) Patent No.: US 9,538,839 B2
(45) Date of Patent: Jan. 10, 2017

(54) FURNISHING ELEMENT HAVING A FOLDING SUPPORT SHELF AND/OR A FOLDING SUPPORT STRUCTURE

(71) Applicant: ARPER S.p.A., Monastier di Treviso, Treviso (IT)

(72) Inventor: Carlo Favaro, Treviso (IT)

(73) Assignee: ARPER S.p.A., Monastier di Treviso, Treviso (IT)

( * ) Notice: Subject to any disclaimer, the term of this patent is extended or adjusted under 35 U.S.C. 154(b) by 0 days.

(21) Appl. No.: 14/594,825

(22) Filed: Jan. 12, 2015

(65) Prior Publication Data

US 2015/0196115 A1 Jul. 16, 2015

(30) Foreign Application Priority Data

Jan. 13, 2014 (IT) ..... PD2014A0005

(51) Int. Cl.

| | |
|---|---|
| ***A47B 3/00*** | (2006.01) |
| ***A47B 3/08*** | (2006.01) |
| ***A47C 4/00*** | (2006.01) |
| ***A47C 9/00*** | (2006.01) |
| ***A47C 3/18*** | (2006.01) |

(52) U.S. Cl.

CPC ..... *A47B 3/0803* (2013.01); *A47B 3/0818* (2013.01); *A47C 3/18* (2013.01); *A47C 4/00* (2013.01); *A47C 9/00* (2013.01); *A47B 2003/0806* (2013.01); *A47B 2003/0824* (2013.01)

(58) Field of Classification Search

CPC ..... A47B 3/00; A47B 3/08
USPC ..... 108/4, 6, 8, 115, 129, 131, 132
See application file for complete search history.

(56) References Cited

U.S. PATENT DOCUMENTS

| | | | | |
|---|---|---|---|---|
| 6,336,414 | B1 * | 1/2002 | Stewart | A47B 3/0815 108/115 |
| 6,637,352 | B1 * | 10/2003 | Thode | A47B 3/08 108/115 |
| 7,634,968 | B2 * | 12/2009 | Cornelius | A47B 3/0803 108/115 |
| 7,703,400 | B2 * | 4/2010 | Mockel | A47B 3/0803 108/115 |

(Continued)

FOREIGN PATENT DOCUMENTS

DE 201 18 884 U1 2/2002

OTHER PUBLICATIONS

Italian Search Report for corresponding Italian Patent Application No. PD2014A000005 mailed Aug. 28, 2014.

*Primary Examiner* — Matthew Ing
(74) *Attorney, Agent, or Firm* — Merchant & Gould P.C.

(57) ABSTRACT

A furnishing element, such as a table, a stool, or a desk includes a support structure having at least one support leg defining a vertical axis, a support shelf, supported by and connected to the support structure by a connector. In a use configuration, the support shelf is parallel to a horizontal plane. The connector includes a first joint and a second joint independent of each other. The first joint identifies a first hinge axis parallel to the horizontal plane to permit rotation and folding of the support shelf towards the support structure, to position the support shelf perpendicular to the horizontal plane in a folded configuration. The second joint identifies a second hinge axis which permits rotation of the support leg towards the support shelf, to position the support leg parallel to the horizontal plane in a folded configuration.

12 Claims, 8 Drawing Sheets

(56) References Cited

U.S. PATENT DOCUMENTS

| | | | | |
|---|---|---|---|---|
| 7,765,938 | B2 * | 8/2010 | Piretti | A47B 7/02 108/115 |
| 8,272,336 | B2 * | 9/2012 | Rutz | A47B 3/08 108/115 |
| 8,291,830 | B2 * | 10/2012 | Rutz | A47B 3/0818 108/115 |
| 2004/0083932 | A1 | 5/2004 | Kottman et al. | |
| 2011/0139042 | A1 * | 6/2011 | Korb | A47B 3/00 108/115 |

* cited by examiner

FURNISHING ELEMENT HAVING A FOLDING SUPPORT SHELF AND/OR A FOLDING SUPPORT STRUCTURE

This application claims benefit of Serial No. PD2014A000005, filed 13 Jan. 2014 in Italy and which application is incorporated herein by reference. To the extent appropriate, a claim of priority is made to the above disclosed application.

FIELD OF APPLICATION

The present invention relates to a furnishing element, such as a table, a desk, a stool, having a support shelf and/or a folding structure.

STATE OF THE ART

As is known, in the furniture industry the need is felt to make furnishing elements which can be easily folded both in order to facilitate the transport and to reduce the overall dimensions thereof when not in use.

PRESENTATION OF THE INVENTION

To solve the problems mentioned above, to date various solutions have been adopted in the art which provide, for example, for facilitating the dismantling and subsequent reassembly of the components of the furnishing element, so as to enable the easy and rapid dismantling and assembly of said element.

Said solutions are impractical and inconvenient since they provide, in any case, for a dismantling step and subsequent reassembly of the components of the furnishing element. Furthermore, as the dismantling/assembly cycles increase these may cause premature wear of the attachment elements of the various components.

Solutions of furnishing elements which comprise retractable or folding elements in order to reduce the overall dimensions are also known: such solutions do not however guarantee an optimal reduction of the dimensions especially when the furnishing element is assembled but not in use.

Moreover, said solutions involve the use of connection joints between the walls which are bulky and unsightly or in any case invasive compared to the lines and shapes of said furnishing element.

The need is therefore felt to resolve the drawbacks and limitations mentioned with reference to the prior art.

DESCRIPTION OF THE DRAWINGS

Further characteristics and advantages of the present invention will be more clearly comprehensible from the description given below of its preferred and non-limiting embodiments, wherein.

The elements or parts of elements common to the embodiments described below will be indicated using the same reference numerals.

DETAILED DESCRIPTION

Figure 1:
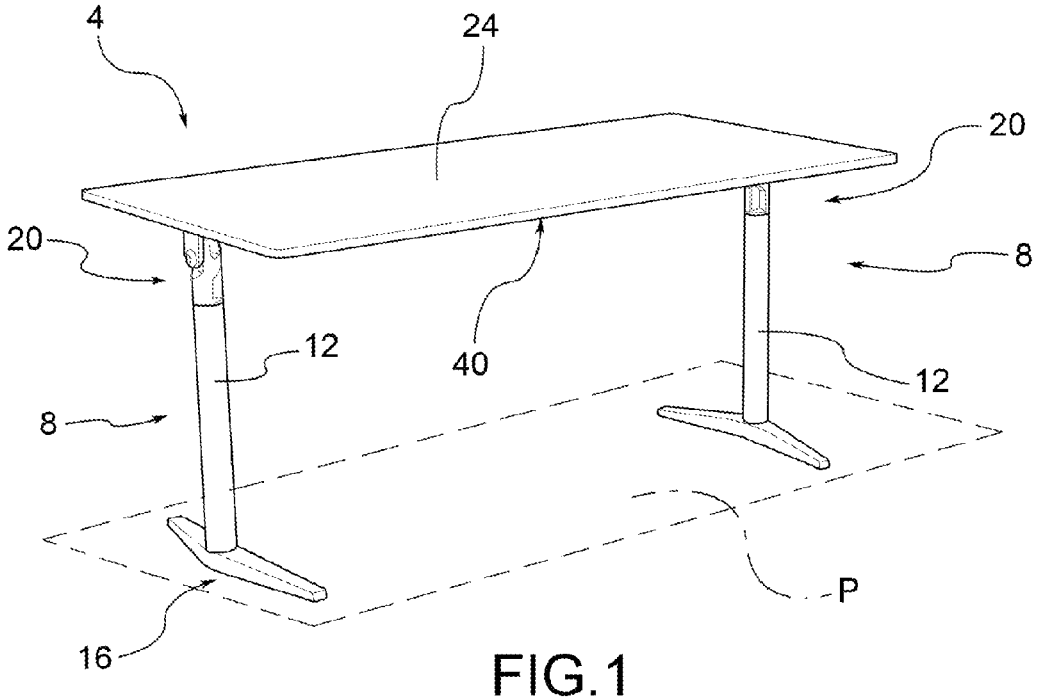
FIGS. 1-2 are views from different angles of a furnishing element according to the present invention, in the open configuration or configuration of use.

With reference to the aforementioned figures, reference numeral 4 globally denotes a schematic overall view of a furnishing element, according to the present invention.

For the purposes of the present invention, it should be noted that the term furnishing element should be considered in the broad sense, comprising for example a table, a stool, a desk and the like. Furthermore, for the purposes of the present invention, the furnishing element 4 may be made of any material and be any shape and size.

The furnishing element 4 comprises a support structure 8 having at least one support leg 12 which defines a vertical axis V directed in a main vertical direction Y-Y, in the open configuration or configuration of use of the furnishing element.

As seen, the furnishing element 4 may also comprise a single support leg 12, for example creating a table or stool, or may comprise two or more support legs 12.

The support legs 12 are preferably, but not necessarily, a rectilinear shape parallel to said main vertical direction Y-Y.

The support legs 12 can be any shape and size and even be curvilinear.

The support legs extend from a lower end or foot 16 which stands on a floor or support surface of the furnishing element 4 to an upper end 20 at which the support leg is connected to an associable support shelf 24.

According to a possible embodiment, the support leg 12, at said lower end or foot 16, is fitted with a wheel, a bearing or a sliding block (not shown), in order to facilitate the movement of the furnishing element; said wheels or bearings or sliding blocks may be fitted with brakes or blocks, in a known manner.

The furnishing element 4 comprises a support shelf 24, supported by said support structure 8 and connected to the support structure 8 by the interposition of connection means 28.

The support shelf 24, for the purposes of the present invention, may be any shape and size and may be made of any material.

The support shelf 24, in a configuration of use, is positioned parallel to a horizontal plane P perpendicular to said main vertical direction Y-Y. The horizontal plane P is typically a support plane for the furnishing element 4, such as a floor surface of the room in which the furnishing element 4 is placed.

Advantageously, the connection means 28 comprise a first and a second joint 32, 36 independent of each other.

Independent is understood to mean that said first and second joints 32, 36 can be blocked and released independently of each other according to the desired functions of use, as better described below.

The first joint 32 identifies a first hinge axis X-X parallel to the horizontal plane P to permit the rotation and folding of the support shelf 24 towards the support structure 8, so as to be able to position the support shelf 24 perpendicular to said horizontal plane P, in a folded configuration, In other words thanks to the first joint 32 it is possible to place the support shelf in the main vertical direction Y-Y.

Advantageously, the second joint 36 identifies a second hinge axis W-W which permits the rotation of the at least one support leg 12 towards the support shelf 24, so as to position the support leg 12 parallel to the horizontal plane P, in a folded configuration.

In other words, in the folded configuration it is possible to store the support leg 12 towards a bottom wall 40 of the support shelf 24, facing towards the support structure 8 of the furnishing element 4.

According to one embodiment, the first and the second hinge axes X-X, W-W are incident to each other.

For example, the second hinge axis W-W intersects the horizontal plane P.

Preferably said first and second hinge axes X-X, W-W identify an acute angle $\alpha$, so that at least one support leg 12, during the rotation movement around the second joint 36, describes a conical surface having as its generatrix the vertical axis V and as its vertex the point of intersection between the vertical axis V and the second hinge axis W-W.

According to one embodiment, said acute angle $\alpha$ is between 30 and 60 degrees.

Preferably, the acute angle $\alpha$ is equal to 45 degrees.

Figure 12:
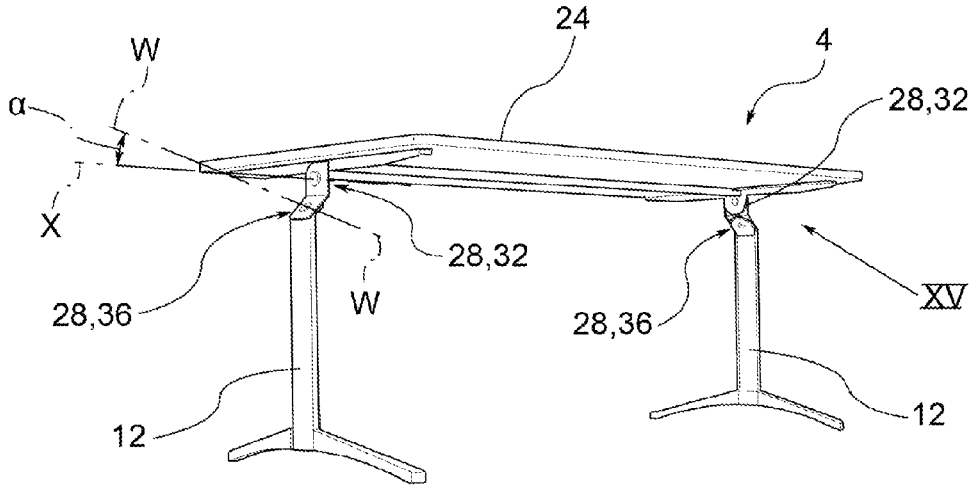
FIG. 12 is a perspective view of a furnishing element according to a further embodiment of the present invention, in the open configuration or configuration of use.
Figure 13:
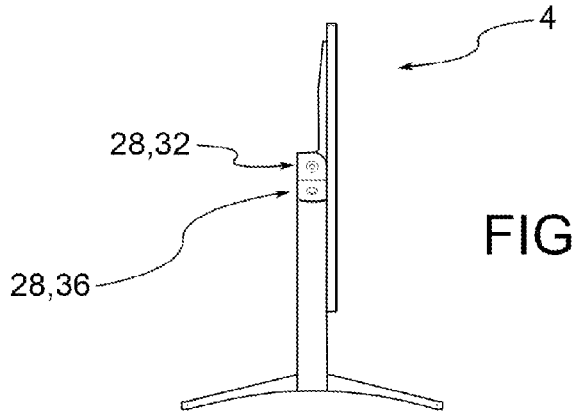
FIG. 13 shows the furnishing element in FIG. 12 in the partially closed configuration.
Figure 14:
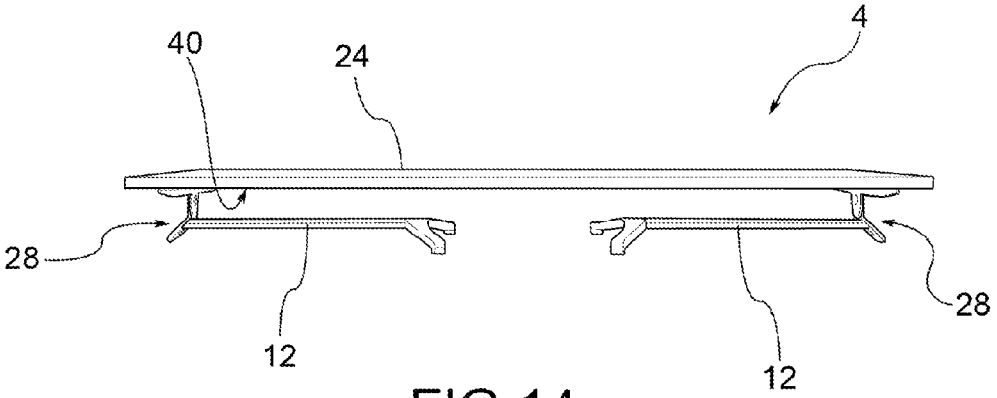
FIG. 14 is a side view of the furnishing element in FIG. 12 in the fully closed configuration.
Figure 15:
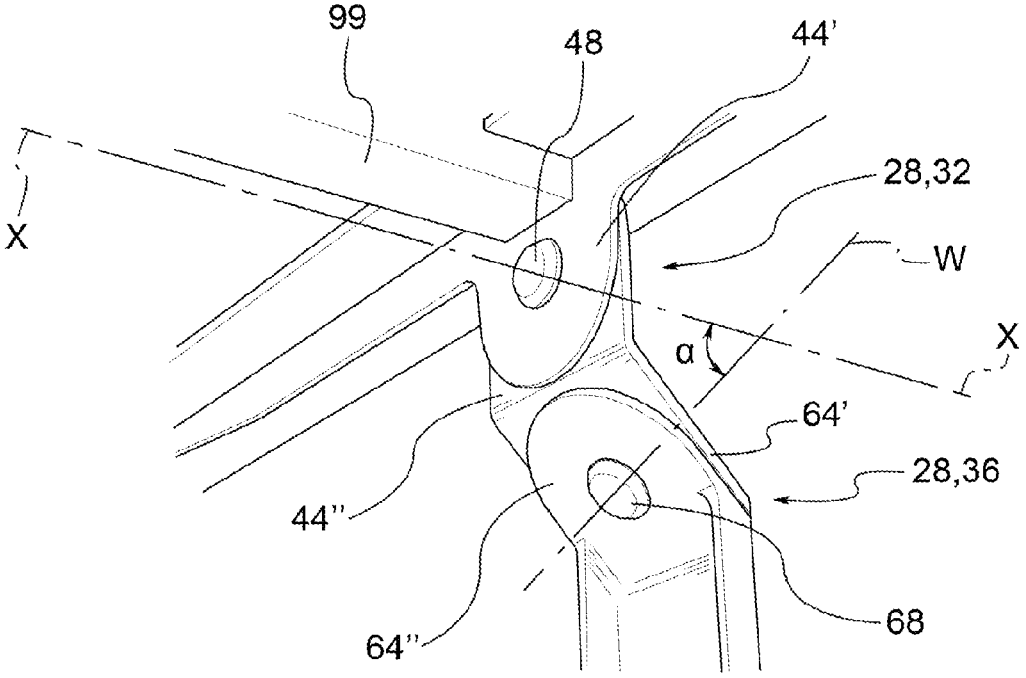
FIG. 15 shows a perspective view of the enlarged detail XV in FIG. 12.

According to a possible embodiment (FIGS. 12-15) the first joint 32 comprises a pair of plates 44', 44" facing each other and coupled by means of a first pin 48 directed perpendicular to said plates 44', 44" along the first hinge axis X-X, a first plate 44' being connected to the support shelf 24 and a second plate 44" being connected to the support leg 12.

Figure 2:
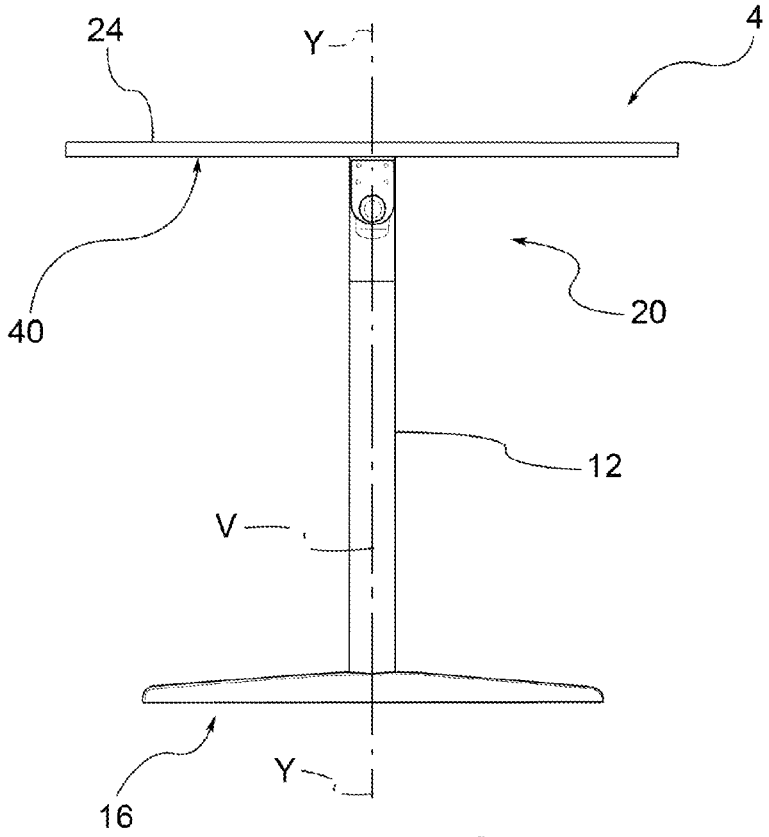
Figure 3:
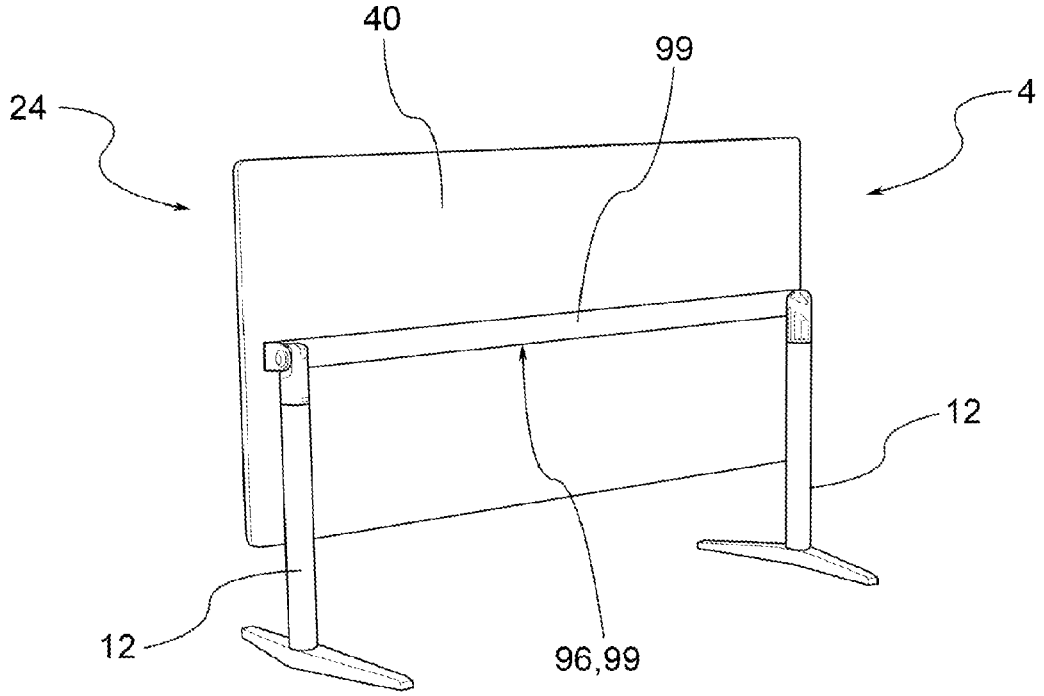
FIGS. 3-5 are views from different angles of the furnishing element in FIG. 1, in a partially closed configuration.
Figure 4:
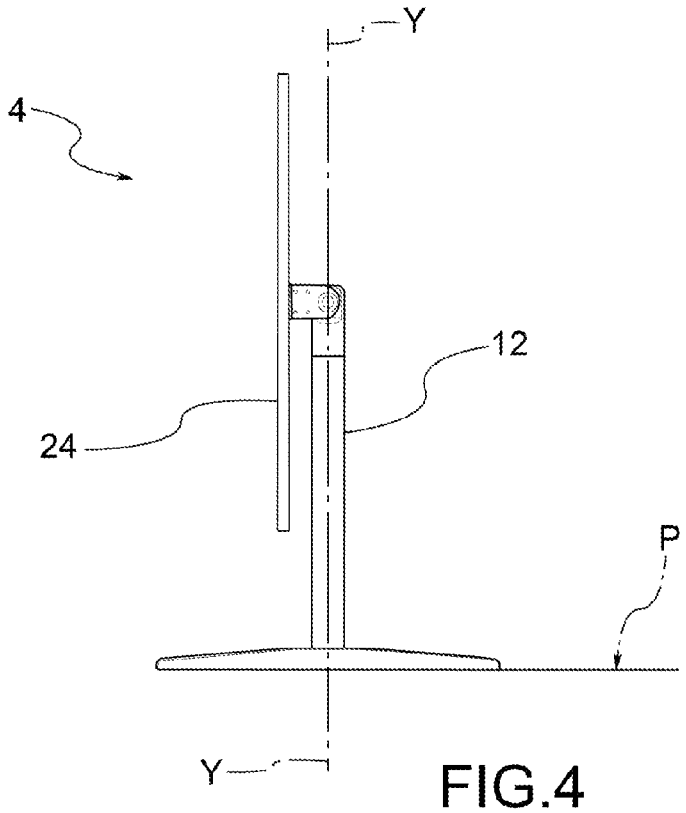
Figure 5:
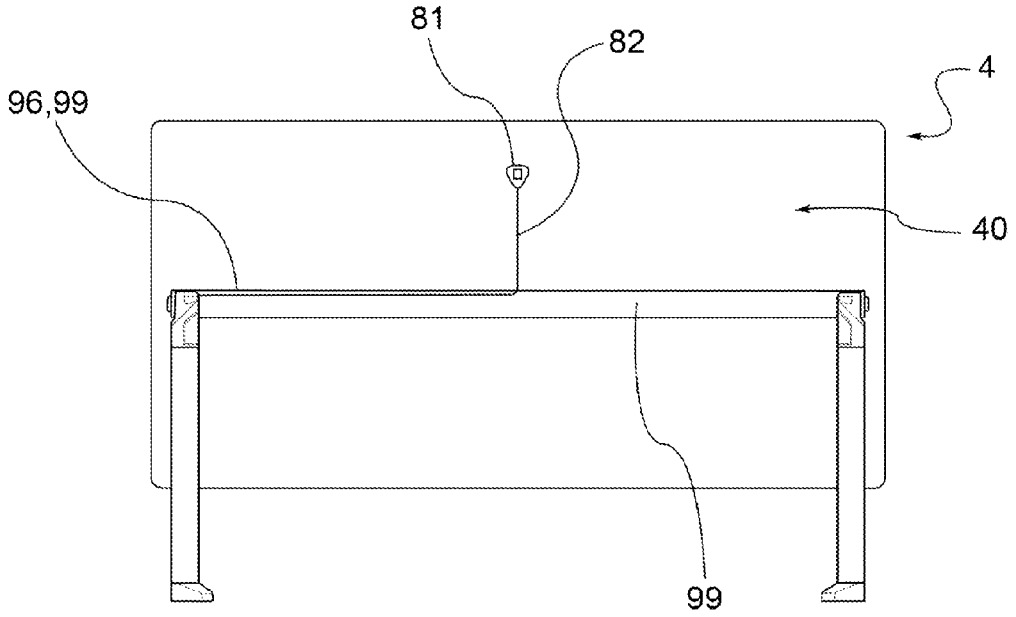
Figure 6:
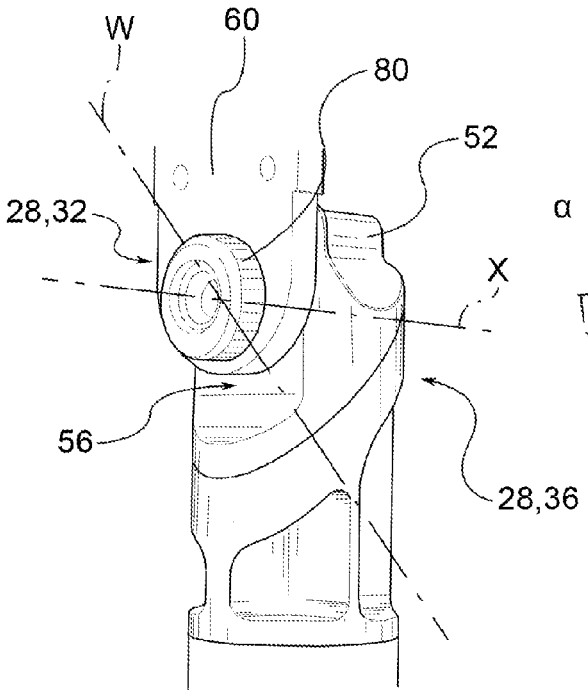
FIGS. 6-7 are views from different angles of a detail of the furnishing element in FIG. 1.
Figure 7:
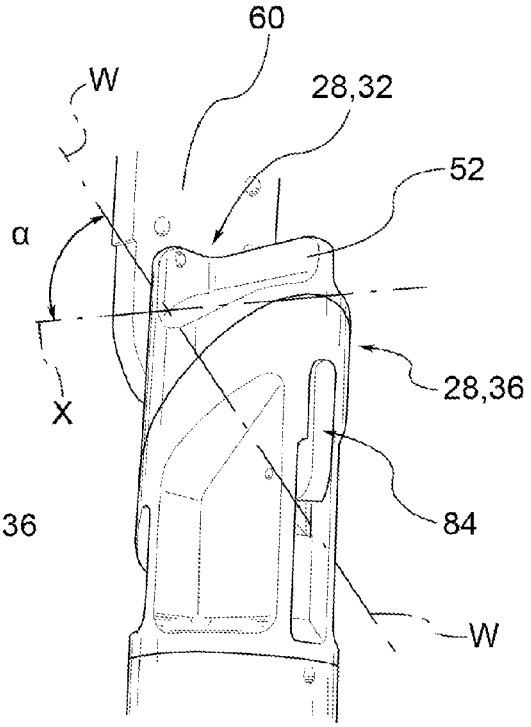
Figure 8:
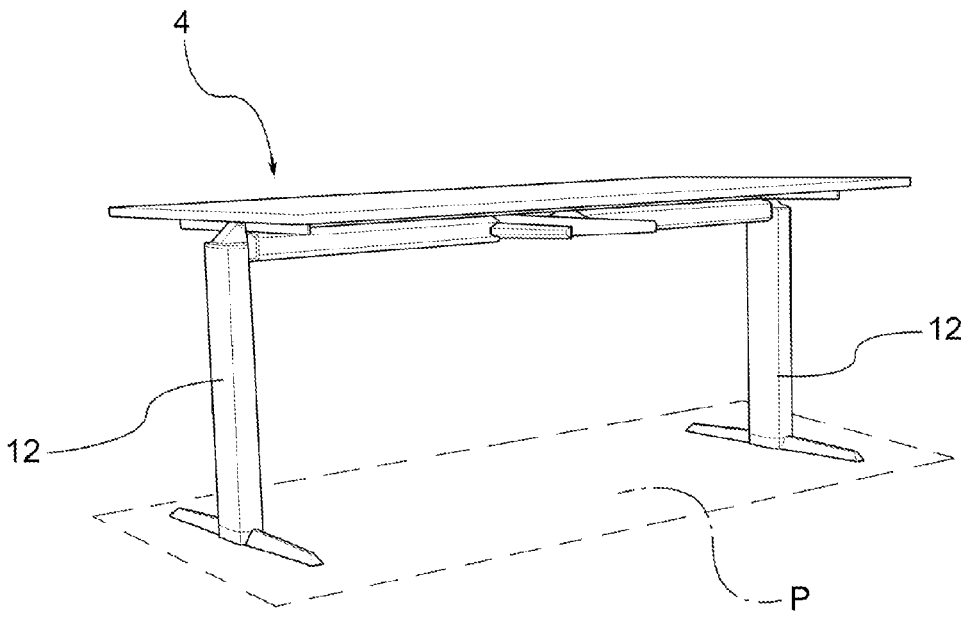
FIGS. 8-9 are views from different angles of a furnishing element according to further embodiments of the present invention, in the open configuration or configuration of use.
Figure 9:
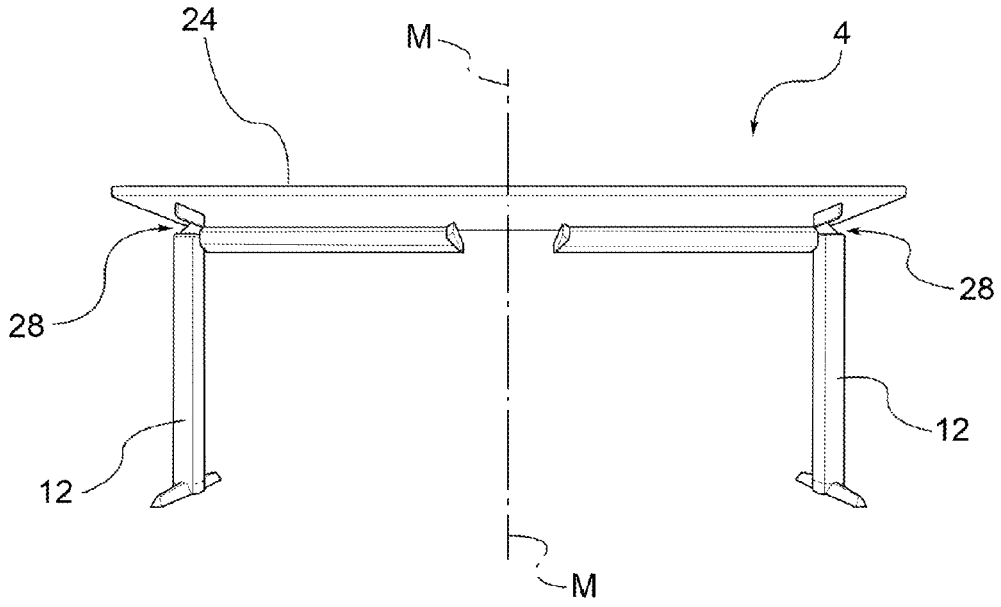
Figure 10:
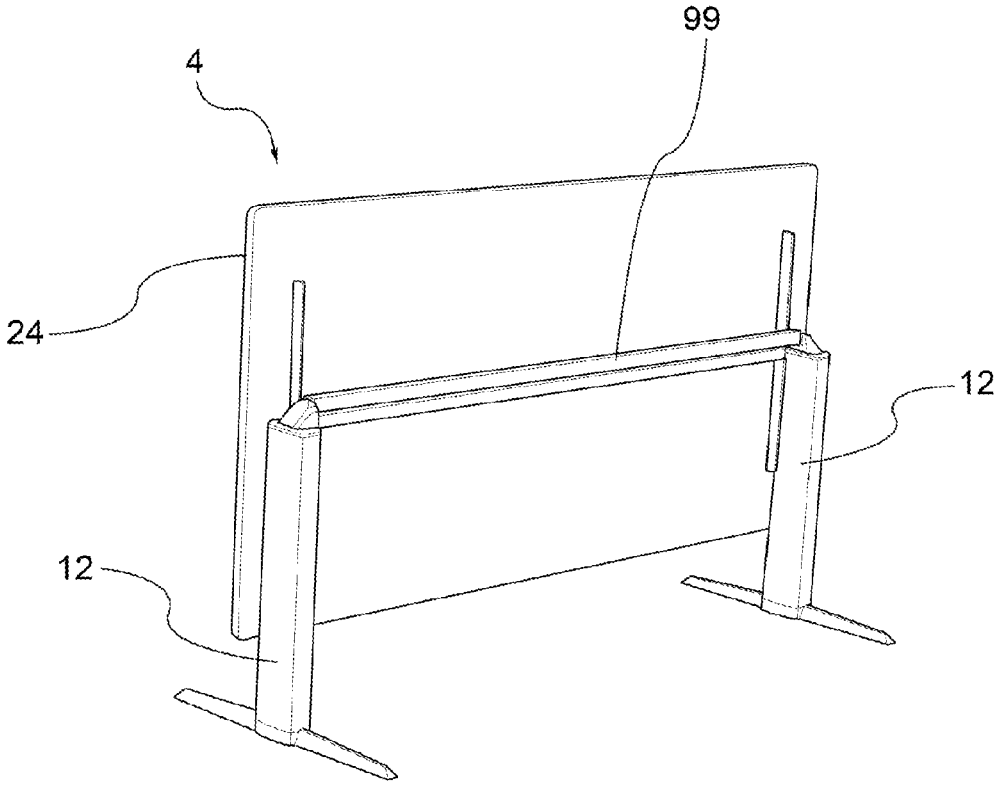
FIG. 10 shows the furnishing element in FIG. 9 in the partially closed configuration.
Figure 11:
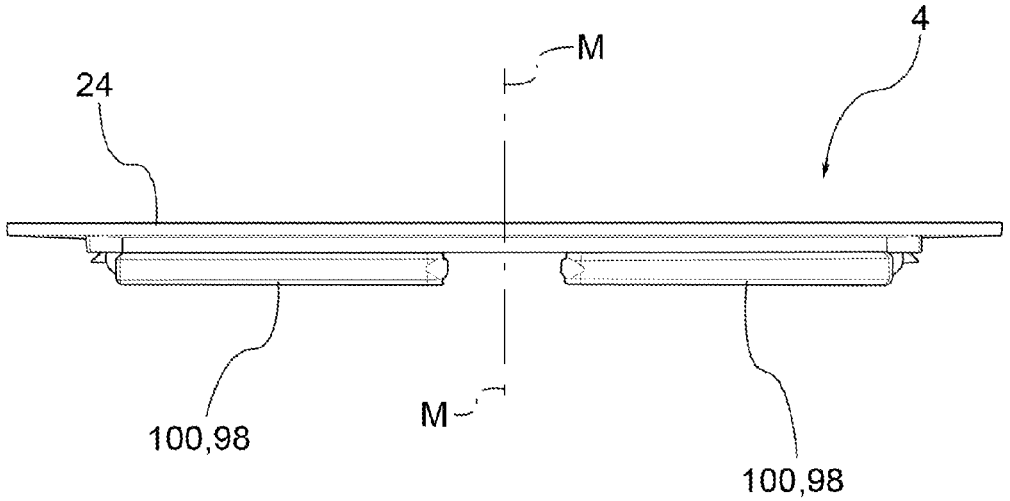
FIG. 11 shows the furnishing element in FIG. 9 in the completely or fully closed configuration.
Figure 16:
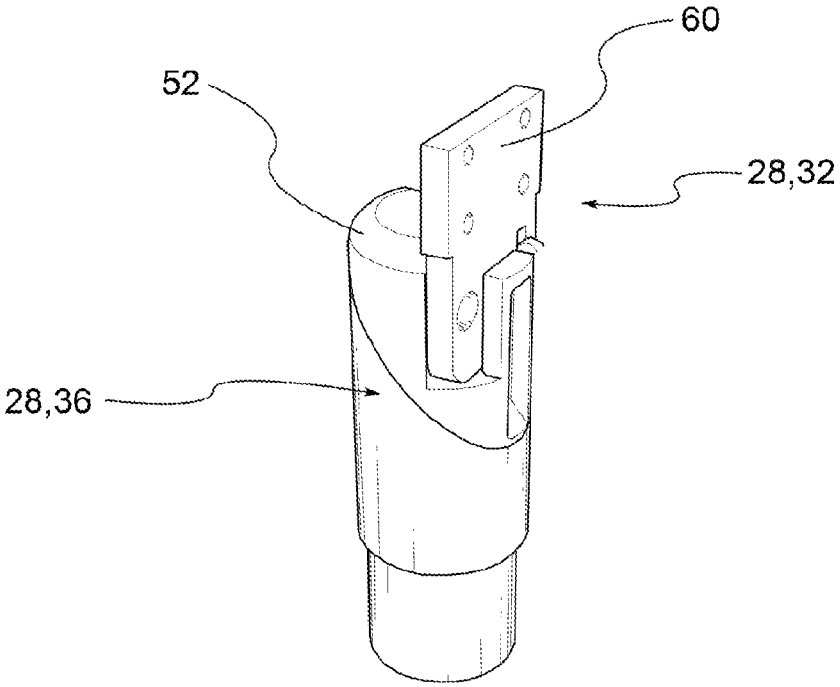
FIG. 16 is a perspective view, in an assembled configuration, of a joint for the furnishing element according to the present invention.
Figure 17:
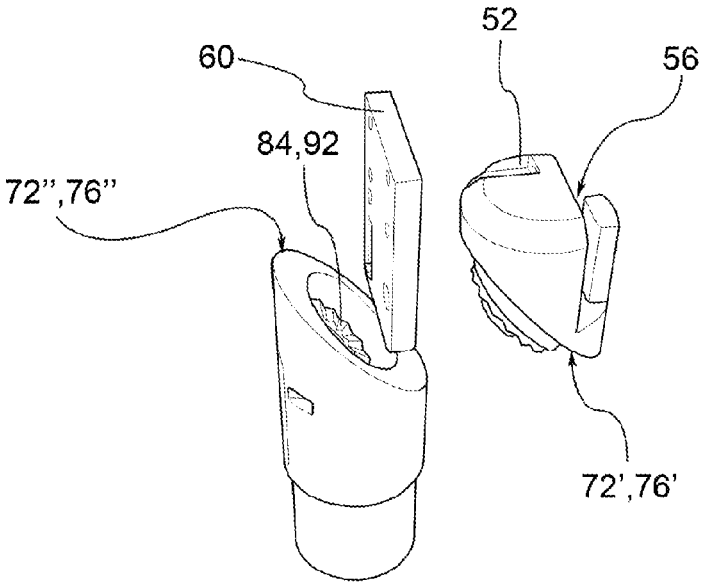
FIGS. 17-18 are exploded perspective views from different angles, of the joint in FIG. 16.
Figure 18:
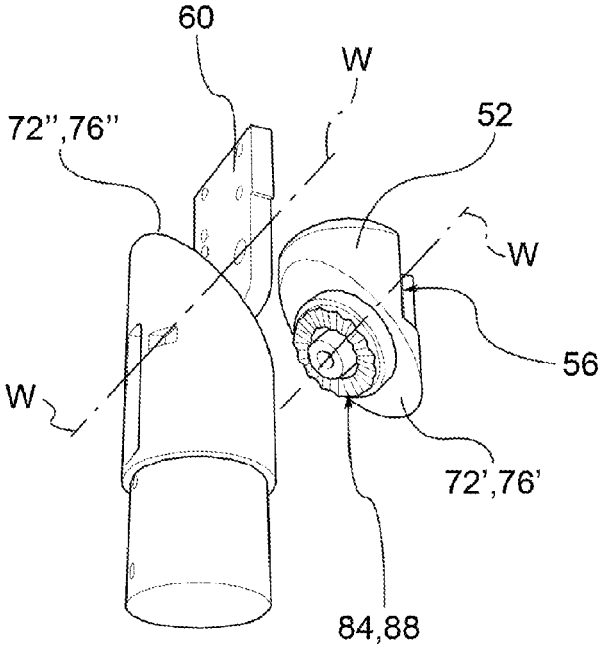
Figure 19:
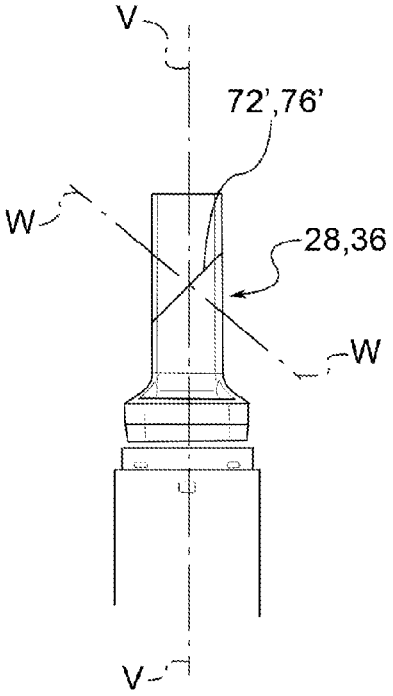
FIG. 19 is a view of a joint for the furnishing element according to a further embodiment of the present invention.

According to a further embodiment (FIGS. 1-7, 16-19), the first joint 32 comprises a body 52 which identifies a seat 56, and a support plate 60 at least partially housed in said seat 56 during its rotation. In other words, the seat 56 is at least counter-shaped relative to the support plate 60 so as to allow it to rotate integrally with the support shelf without interfering with it.

According to a possible embodiment (FIGS. 12-15) the second joint 36 comprises a pair of inclined plates 64', 64" facing each other and coupled by means of a second pin 68 directed perpendicular to the inclined plates 64', 64" along the second hinge axis W-W, wherein a first inclined plate 64' is connected to the support shelf 24 and a second inclined plate 64" is connected to the support leg 12.

According to a possible embodiment (FIGS. 1-7, 16-19), the second joint 36 comprises a pair of abutments 72', 72" fitted with respective inclined planes 76', 76" counter-shaped to each other and perpendicular to the second hinge axis W-W, wherein a first inclined plane 76' is connected to the support shelf 24 and a second inclined plane 76" is connected to the support leg 12.

According to a preferred embodiment, the first and the second joint 32, 36 are at least partially integrated.

For example, the second plate 44" of the first joint 32 is in one piece, or firmly attached to the first inclined plate 64' of the second joint 36 (FIGS. 12-15).

For example, the body 52 of the first joint 32 forms the first abutment 72', fitted with the first inclined plane 76', wherein the first abutment 72' is associated to the second abutment 72", fitted with the second inclined plane 76", and is attached to the upper end 20 of the support leg 12.

According to a possible embodiment, the first joint 32 comprises locking/release means 80 to permit the desired rotation of the support shelf 24 in relation to the support leg 12 and the fixing of the support shelf 24 in the predefined position.

According to a possible embodiment, the first locking/release means 80 comprise a friction mechanism so as to permit a regulation of the fluidity of the rotation movement of the support shelf 24.

According to a possible embodiment, the first locking/release means 80 comprise a knob or lever 81 operatively connected, by pulleys or cables 82, to the first joint 32 and to the support plate 60.

Preferably, the second joint 36 comprises second locking/release means 84 to permit the desired rotation of the support leg 12 in relation to the support shelf 24 and the fixing of the support leg 12 in the predefined position.

For example, the second locking/release means 84 comprise a plurality of protuberances 88 and of relative recesses 92 suitable to selectively receive the protuberances 88, wherein the protuberances 88 and the recesses 92 are integrally attached to the support leg 12 and to the support shelf 24 or vice versa; the engaged condition between the protuberances 88 and the recesses 92 determines a blocking of the rotation of the second joint 36 and the disengaged condition permits the release and thus the rotation of the second joint 36.

As seen, the furnishing element 4 may comprise at least two support legs 12 each having a first and a second joint 32, 36 positioned symmetrically to each other, on each respective support leg 12, in relation to a centreline plane M-M of the support shelf 24.

According to one embodiment, the second joint 36 of each support leg 12 is configured in such a way as to permit a rotation of 360 degrees of the support leg 12 around the second rotation axis W-W.

According to a preferred embodiment, the furnishing element 4 comprises a pair of support legs 12 distanced from each other by a centre-to-centre distance 96, parallel to the support shelf 24, in which each support leg 12 has a vertical extension, measured parallel to the main vertical direction Y-Y, less than half said centre-to-centre distance 96.

Preferably, the two support legs 12 are interconnected by at least one connection cross member 99 which connects the legs at their respective upper ends 20 and, even more preferably, which connects the respective first joints 32 of each leg to each other.

The support leg 12 may be of the telescopic type, comprising a stem 98 at least partially slidingly housed in a lining 100, so as to permit a modification of the overall length of the support leg 12 in said main vertical direction Y-Y.

According to one embodiment variant, the furnishing element 4 is provided with drive means kinematically connected to the support shelf 24 to operate the rotation of the support shelf 24 in relation to the support legs 12, around the first hinge axis X-X.

In addition the furnishing element 4 may be provided with drive means kinematically connected to the support legs 12 to operate the rotation of the support legs 12 in relation to the support shelf 24, around the second hinge axis W-W.

Preferably, the drive means of the furnishing element 4 are operatively connected to the first and/or second locking/release means 80, 84 of the support shelf 24 and of the support legs 12, so as to command the rotation of the support shelf 24 and/or of the support legs 12, after releasing the locking/release means 80, 84 and so as to impose the locking of said locking/release means 80, 84 at the end of such rotation.

The drive means preferably comprise electric motors.

The functioning and method of use of a furnishing element according to the present invention will now be described.

In particular, in the configuration of use, the support shelf is arranged horizontally, perpendicular to the support legs, in a known manner.

In the case in which the furnishing element is to be stored or closed, to increase the available space in the room in which the furnishing element is placed, it is possible to fold the support shelf, after releasing the release means thereof.

This way, the support surface can be rotated around the first joint, along the first hinge axis, so as to be brought into a position parallel to the vertical direction, i.e. perpendicular to the floor or support plane of the furnishing element.

This way a partial closure of the furnishing element is achieved.

Obviously in the case in which the furnishing element has a plurality of support legs, for example, two support legs, each first joint identifies hinge axes coinciding with each other so as to impose the same rotation on the support shelf.

This way it considerably reduces the dimensions of the furnishing element which, still supported by the support legs, can be easily moved, for example next to the walls of the room it is placed in.

If necessary, the support shelf can be easily returned to the position of use, i.e. horizontal position.

In the case of wishing to transport the furnishing element, it is possible, after releasing the release means of the support legs, to fold the support legs by rotating them around their second hinge axes.

In this case a configuration of total or complete closure is achieved.

In the case in which, for example, the furnishing element is provided with a pair of support legs, it is possible to impose angles of rotation on the legs opposite to each other so as to avoid any interference between said legs.

It is also possible, as seen, to provide for the legs to have lengths less than half the respective centre-to-centre distance or which are for example partially retractable.

In the closed configuration of the legs, they assume a position parallel to the support shelf, on the underside of the shelf, and the furnishing element adopts a particularly compact conformation which significantly facilitates its transport without requiring any dismantling of components or the use of any type of tool.

As may be appreciated from the description, the furnishing element according to the invention makes it possible to overcome the drawbacks of the prior art.

In particular, the furnishing elements according to the invention make it possible to significantly reduce the overall dimensions, when not in use, by simply rotating the support shelf and placing it in a position substantially perpendicular to the floor.

Said rotation of the support shelf is extremely quick and convenient and does not require any dismantling of components of the furnishing element which remains fixed to its support structure without requiring any additional support.

In said configuration with the support shelf folded, it is therefore possible to significantly reduce the overall dimensions of the furnishing element which can for example be stored on the perimeter wall of a room in order to increase the space available to users.

Furthermore, in said configuration with the support shelf folded, it is however possible to easily move the furnishing element on its own support structure, preferably, but not necessarily, fitted with castors.

Furthermore, in order to facilitate the transport of the furnishing element, it is possible to fold the support structure toward the bottom of the support shelf: this configuration is particularly useful for transporting the furnishing element since on the one hand it considerably reduces the overall dimensions, as if it was completely dismantled, and on the other, once having reached its destination, the furnishing element can be quickly placed in the configuration of use, without requiring any tool, in a convenient and fast manner.

Furthermore the joints used for the connection between the support shelf and the support structure are particularly slender and do not affect the shapes and lines, namely the overall design, of the said furnishing element. As a result, the functionality of the furnishing element according to the invention, in terms of folding, of reduction of the dimensions and greater ease of transport, does not in any way affect the overall design thereof.

A person skilled in the art may make numerous modifications and variations to the furnishing elements described above so as to satisfy contingent and specific requirements while remaining within the sphere of protection of the invention as defined by the following claims.

I claim:

1. A furnishing element, comprising:

a support structure having at least one support leg which defines a vertical axis directed along a main vertical direction;

a support shelf, supported by said support structure and connected to the support structure by interposition of a connector;

wherein the support shelf, in a use configuration, is positioned parallel to a horizontal plane perpendicular to said main vertical direction, wherein said connector comprise a first joint and a second joint independent of each other;

wherein the first joint identifies a first hinge axis parallel to the horizontal plane to permit rotation and folding of the support shelf towards the support structure, so as to position the support shelf perpendicular to said horizontal plane, in a folded configuration;

wherein the second joint identifies a second hinge axis which permits rotation of the at least one support leg towards the support shelf, so as to position the support leg parallel to the horizontal plane, in a folded configuration; and wherein said first hinge axis and second hinge axis identify an acute angle, so that during rotation movement around the second joint, at least one support leg describes a conical surface having as a generatrix the vertical axis and as a vertex a point of intersection between the vertical axis and the second hinge axis.

2. The furnishing element according to claim 1, wherein the first hinge axis and the second hinge axis are incident to each other.

3. The furnishing element according to claim 1, wherein the second hinge axis intersects the horizontal plane.

4. The furnishing element according to claim 1, wherein said acute angle is 30 to 60 degrees.

5. The furnishing element according to claim 1, wherein said acute angle is 45 degrees.

6. The furnishing element according to claim 1, wherein the second joint comprises a second lock/release to permit desired rotation of the support leg in relation to the support shelf and fixing of the support leg in the predefined position.

7. The furnishing element according to claim 1, wherein the furnishing element comprises at least two support legs each having a first joint and a second joint positioned symmetrically to each other, on each respective support leg, in relation to a centerline plane of the support shelf.

8. The furnishing element according to claim 1, wherein the furnishing element comprises a pair of support legs distanced from each other by a center to center distance, parallel to the support shelf, in which each support leg has a vertical extension, parallel to the main vertical direction, less than half of said center to center distance.

9. A furnishing element, comprising:

a support structure having at least one support leg which defines a vertical axis directed along a main vertical direction;

a support shelf, supported by said support structure and connected to the support structure by interposition of a connector;

wherein the support shelf, in a use configuration, is positioned parallel to a horizontal plane perpendicular to said main vertical direction, wherein said connector comprise a first joint and a second joint independent of each other;

wherein the first joint identifies a first hinge axis parallel to the horizontal plane to permit rotation and folding of the support shelf towards the support structure, so as to position the support shelf perpendicular to said horizontal plane, in a folded configuration;

wherein the second joint identifies a second hinge axis which permits rotation of the at least one support leg towards the support shelf, so as to position the support leg parallel to the horizontal plane, in a folded configuration; and wherein the first joint comprises a body which identifies a seat and a support plate at least partially housed in said seat during rotation.

10. A furnishing element, comprising:

a support structure having at least one support leg which defines a vertical axis directed along a main vertical direction;

a support shelf, supported by said support structure and connected to the support structure by interposition of a connector;

wherein the support shelf, in a use configuration, is positioned parallel to a horizontal plane perpendicular to said main vertical direction, wherein said connector comprise a first joint and a second joint independent of each other;

wherein the first joint identifies a first hinge axis parallel to the horizontal plane to permit rotation and folding of the support shelf towards the support structure, so as to position the support shelf perpendicular to said horizontal plane, in a folded configuration;

wherein the second joint identifies a second hinge axis which permits rotation of the at least one support leg towards the support shelf, so as to position the support leg parallel to the horizontal plane, in a folded configuration; and wherein the first joint comprises a lock/release to permit desired rotation of the support shelf in relation to the at least one support leg and fixing of the support shelf in a predefined position.

11. The furnishing element according to claim 10, wherein the first lock/release comprise a friction mechanism to permit regulation of the fluidity of the rotation movement of the support shelf.

12. A furnishing element, comprising:

a support structure having at least one support leg which defines a vertical axis directed along a main vertical direction;

a support shelf, supported by said support structure and connected to the support structure by interposition of a connector;

wherein the support shelf, in a use configuration, is positioned parallel to a horizontal plane perpendicular to said main vertical direction, wherein said connector comprise a first joint and a second joint independent of each other;

wherein the first joint identifies a first hinge axis parallel to the horizontal plane to permit rotation and folding of the support shelf towards the support structure, so as to position the support shelf perpendicular to said horizontal plane, in a folded configuration;

wherein the second joint identifies a second hinge axis which permits rotation of the at least one support leg towards the support shelf, so as to position the support leg parallel to the horizontal plane, in a folded configuration; and wherein the second joint of each support leg is configured to permit rotation of 360 degrees of the support leg around the second rotation axis.

* * * * *